US006357701B1

(12) United States Patent
Luetzow et al.

(10) Patent No.: US 6,357,701 B1
(45) Date of Patent: Mar. 19, 2002

(54) WARNING LIGHT HAVING A SWITCHING SYSTEM

(75) Inventors: Edwin J. Luetzow; Richard L. Luetzow, both of Brookings, SD (US)

(73) Assignee: MTR, Inc., Brookings, SD (US)

( * ) Notice: Subject to any disclaimer, the term of this patent is extended or adjusted under 35 U.S.C. 154(b) by 0 days.

(21) Appl. No.: 09/454,033

(22) Filed: Dec. 3, 1999

(51) Int. Cl.[7] ..... B61L 23/00
(52) U.S. Cl. ..... 246/111
(58) Field of Search ..... 246/112, 1 C, 246/111, 114 R, 473.1, 477, 125, 261, 272

(56) References Cited

U.S. PATENT DOCUMENTS 4,666,108 A 5/1987 Fox
4,784,356 A 11/1988 Fox
4,895,325 A 1/1990 LeVoir
B14,784,356 A * 1/1995 Fox ..... 246/125

* cited by examiner

*Primary Examiner*—S. Joseph Morano
*Assistant Examiner*—Robert J. McCarry, Jr.
(74) *Attorney, Agent, or Firm*—Hugh D. Jaeger

(57) ABSTRACT

A warning light having a switching system where the behavior of a warning light can be altered by actuation of a switching mechanism by rotary actuation of a connector plug. A rotary pin base located adjacent to a connector plug receptor port is rotated by an engaging connector plug to rotationally position pins in the rotary pin base for the purpose of contacting stationary switch pins in a stationary pin base to provide electrical current of different natures and attributes to a warning lamp.

13 Claims, 6 Drawing Sheets

WARNING LIGHT HAVING A SWITCHING SYSTEM

CROSS REFERENCES TO CO-PENDING APPLICATIONS

None.

BACKGROUND OF THE INVENTION

1. Field of the Invention

The present invention is for a warning light, and more particularly, pertains to a warning light having a switching system whose electrical configuration can be easily and readily changed to alter the behavior pattern of one or more warning lights between steady or flashing illumination or other illumination patterns or schemes without laborious configuration modifications, as desired.

2. Description of the Prior Art

Railroad crossing lights on a crossing gate or other supports are provided to exhibit either flashing or steady illumination or combinations of flashing or steady warning lights depending upon use requirements. Once the configuration of warning lights was decided upon, each of the warning lights was hardwired at a position internal to the warning light base or at a plug assembly to generate the desired illumination of each warning light where the illumination was of a steady or flashing nature as desired. Later and subsequent reconfiguration of the warning lights to reflect an altered illumination pattern required reconfiguration of the hardwired wiring system whether internal to the base or whether in the plug assembly. Such reconfiguration required one or more operations such as, but not limited to, desoldering and resoldering and taping of wires, removal and replacement of wire connectors and switching and reconnecting of wires, stripping of wires, reconnection and swapping of wires in pins at plug terminals, and the like. Such operations and reconfigurations require a lengthy reconfiguration time and generally require the use of qualified personnel, such as a licensed electrician or technician. Clearly, what is needed is a warning light having a switching system which is quickly and readily reconfigured in the field by personnel where technical knowledge is not required to execute a change in the behavior of a warning light system.

SUMMARY OF THE INVENTION

The general purpose of the present invention is a warning light having a switching system. Opposing lenses, a lens frame and a light socket and bulb pivotally attach to a configured housing which serves as a mount for the warning light. Opposed connector plug receptor ports having male connection pins extend in an outward direction from opposite ends of the configured housing to accommodate connector plugs having female connection pins. One such set of male connection pins at one end of the configured housing is fixed in position to simply accommodate the female connection pins of one connector plug, as known in the art. However, the opposing male connection pins, also known as rotating pins, are located in and extend through a rotary pin base which is co-located in a connector plug receptor port cavity to align with and to contact stationary switch pins in a stationary pin base. The female pins of a connector plug are brought into intimate contact with the male rotating pins to establish electrical connection and also to provide a means to cause rotation of the rotary pin base and co-located rotating pins. Such a rotary movement about the axis of the rotary pin base is caused by manual rotation of the connector plug thereby causing the rotating pins to reposition in rotational fashion to contact successive stationary switch pins located in the stationary pin base. A spring and a ball located in the housing contacts detent grooves in the rotary pin base to index, reference, register and fix the rotating pins in the rotary pin base in alignment with the stationary switch pins in the stationary pin base. Subsequent to rotational switching, the cap of the connector plug is tightened against threads on the connector plug receptor port to fix and ensure desired alignment of the rotary pin base and the rotating pins, as desired.

According to one embodiment of the present invention, there is provided a warning light with a switching system including a molded configured housing, a lens frame with opposing lenses and a light socket and bulb pivotally attached to the configured housing, opposing connector plug receptor ports extending from the configured housing, fixed male connection pins extending from one side of the configured housing within a connector plug receptor port, rotating pins extending from an opposing side of the configured housing within another connector plug receptor port, a rotary pin base through which the rotating pins fully extend and which is aligned within a connector plug receptor port cavity, stationary switch pins secured in a stationary pin base which align to the rotating pins in the rotary pin, base, a connector plug which is securable to the fixed male connection pins and a connector plug which is securable with respect to the rotating pins and which is incorporated to rotatingly actuate the rotating pins for contacting the stationary switch pins located in the stationary pin base.

One significant aspect and feature of the present invention is a warning light having a switching system.

Another significant aspect and feature of the present invention is a switching system which can deliver electrical current of different attributes to alter the behavior of a warning light.

Another significant aspect and feature of the present invention is a warning light having a switching system which can be reconfigured by a person not having specialized mechanical or electrical skills.

Another significant aspect and feature of the present invention is a switching system for a warning light which eliminates the requirement for manual rewiring of wire configurations to change the attributes of a warning light.

Still another significant aspect and feature of the present invention is a rotary pin base having co-located male rotating pins the entire assembly of which is rotated along and about its axis to interface with and to intimately contact stationary switch pins in a stationary pin base.

Yet another significant aspect and feature of the present invention is the use of a connector plug having female pins to intimately engage the male rotating pins of a rotary pin base whereby the connector plug is rotated to cause rotation of the male rotating pins of the rotary pin base resulting in switching of the male rotating pins with the stationary switch pins in a stationary pin base.

Having thus described an embodiment of the present invention, it is the principal object of the present invention to provide a warning light having a switching system.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

Figure 1:
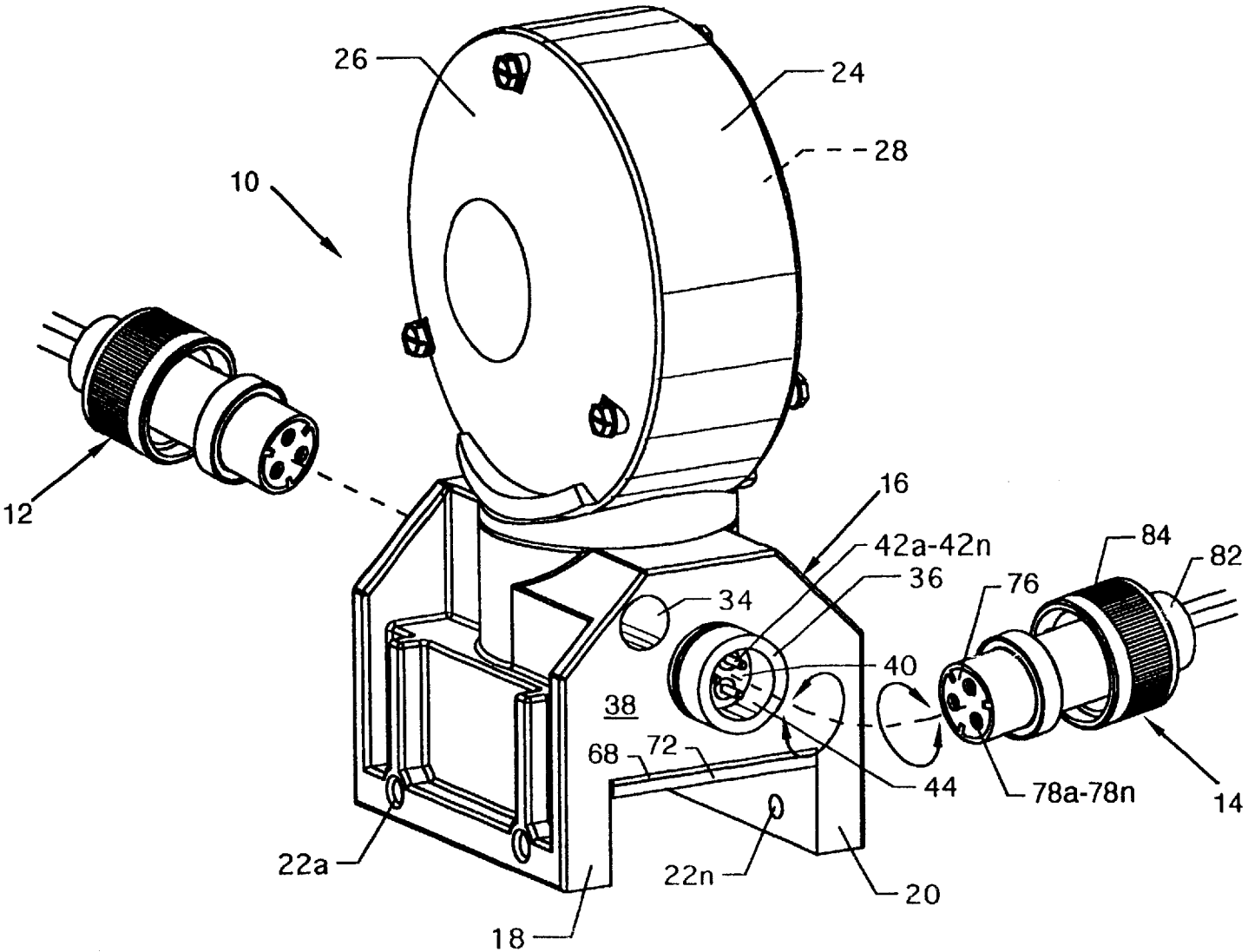
FIG. 1 illustrates an isometric view of a warning light having a switching system, the present invention, for use with adjacently shown connector plugs.

FIG. 1 illustrates an isometric view of a warning light having a switching system, herein called the warning system 10, for use with adjacently shown connector plugs 12 and 14. The warning system 10 centers about a configured housing 16 which serves as a mounting structure for components described herein. The configured housing 16 includes opposing planar tabs 18 and 20 for mounting of the warning system 10 including a plurality of mounting holes 22*a*–22*n*. A lens frame 24, opposing lenses 26 and 28, and a lamp base 30 and electric bulb 32 (FIG. 2) pivotally attach to the upper region of the configured housing 16. An orifice 34 provides access to a lens frame locking mechanism (not shown) which fixes the angular displacement of the lens frame 24 and lenses 26 and 28 with respect to the housing 16.

A connector plug receptor port 36 extends outwardly from a side 38 of the configured housing 16. A rotary pin base 40 having a plurality of rotating pins 42*a*–42*n* aligns in a connector plug receptor port cavity 44. Rotating pins 42*a*–42*n* extend outwardly for accommodation by and electrical connection with the connector plug 14. The connector plug 14, in intimate contact with the rotating pins 42*a*–42*n*, can be rotated along and about its axis to correspondingly rotate the rotating pins 42*a*–42*n* and rotary pin base 40 to effect switching, as later described in detail.

Figure 2:
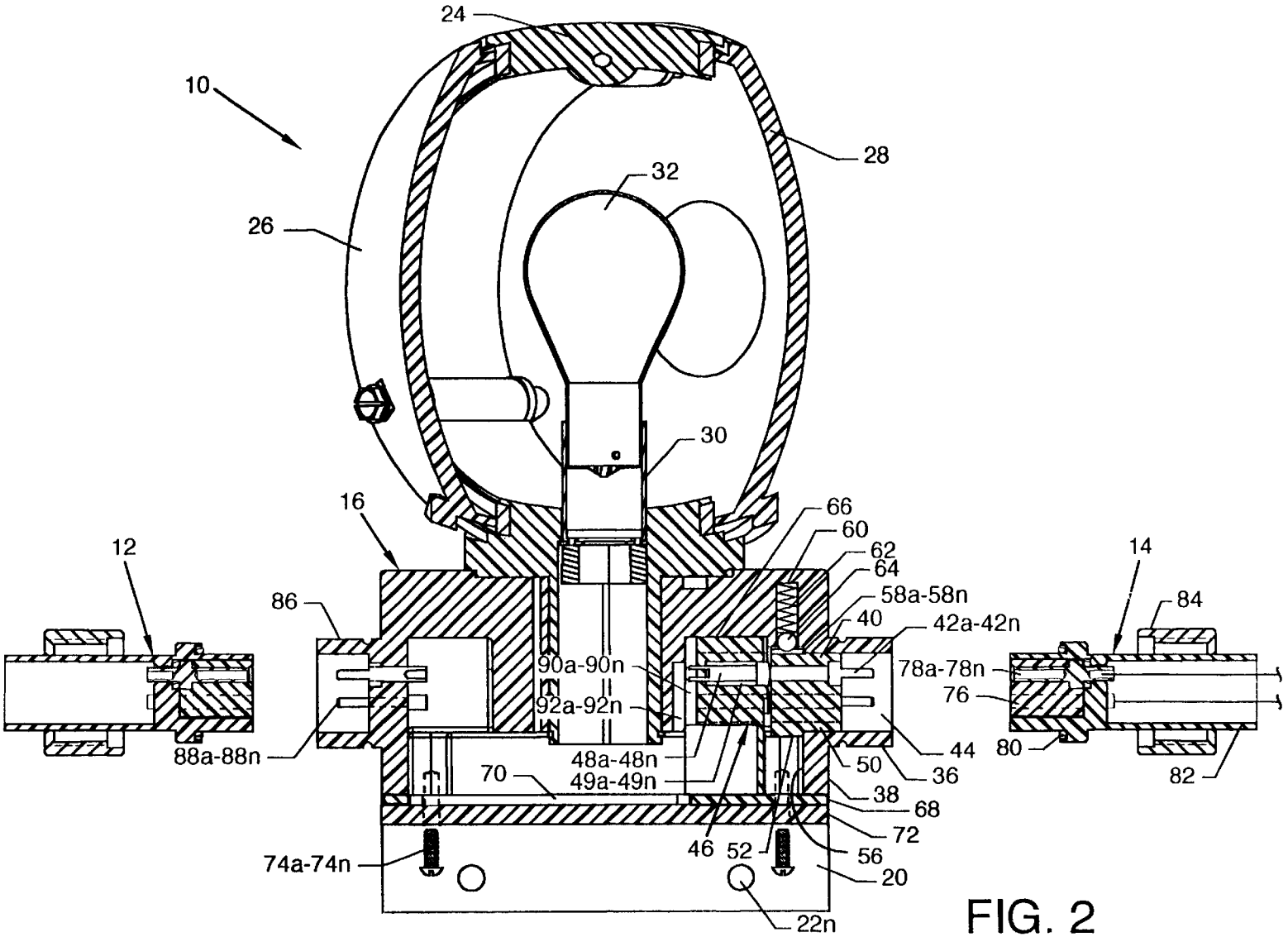
FIG. 2 illustrates a cross section of the warning light having a switching system and adjacent connector plugs.
Figure 3:
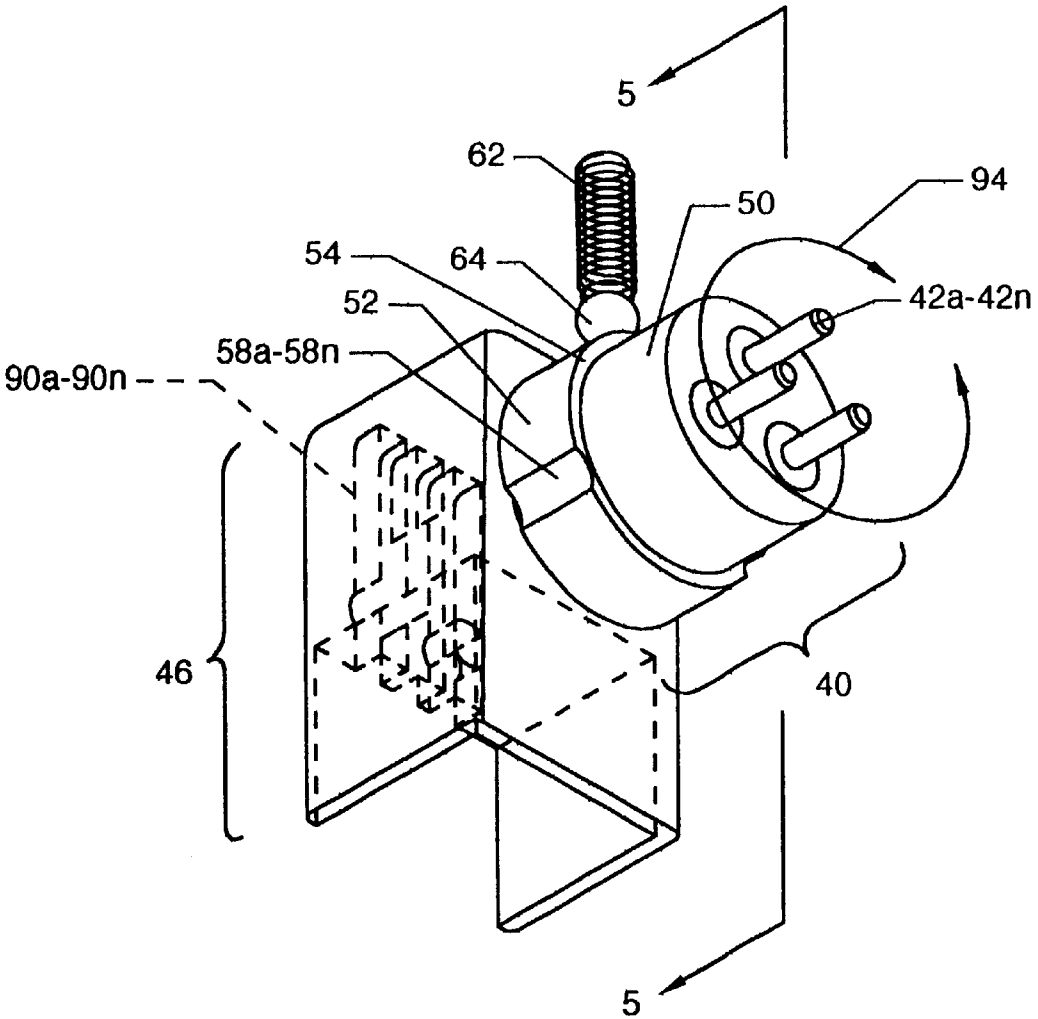
FIG. 3 illustrates an isometric view of the rotary pin base and associated components aligned to the stationary pin base.
Figure 4:
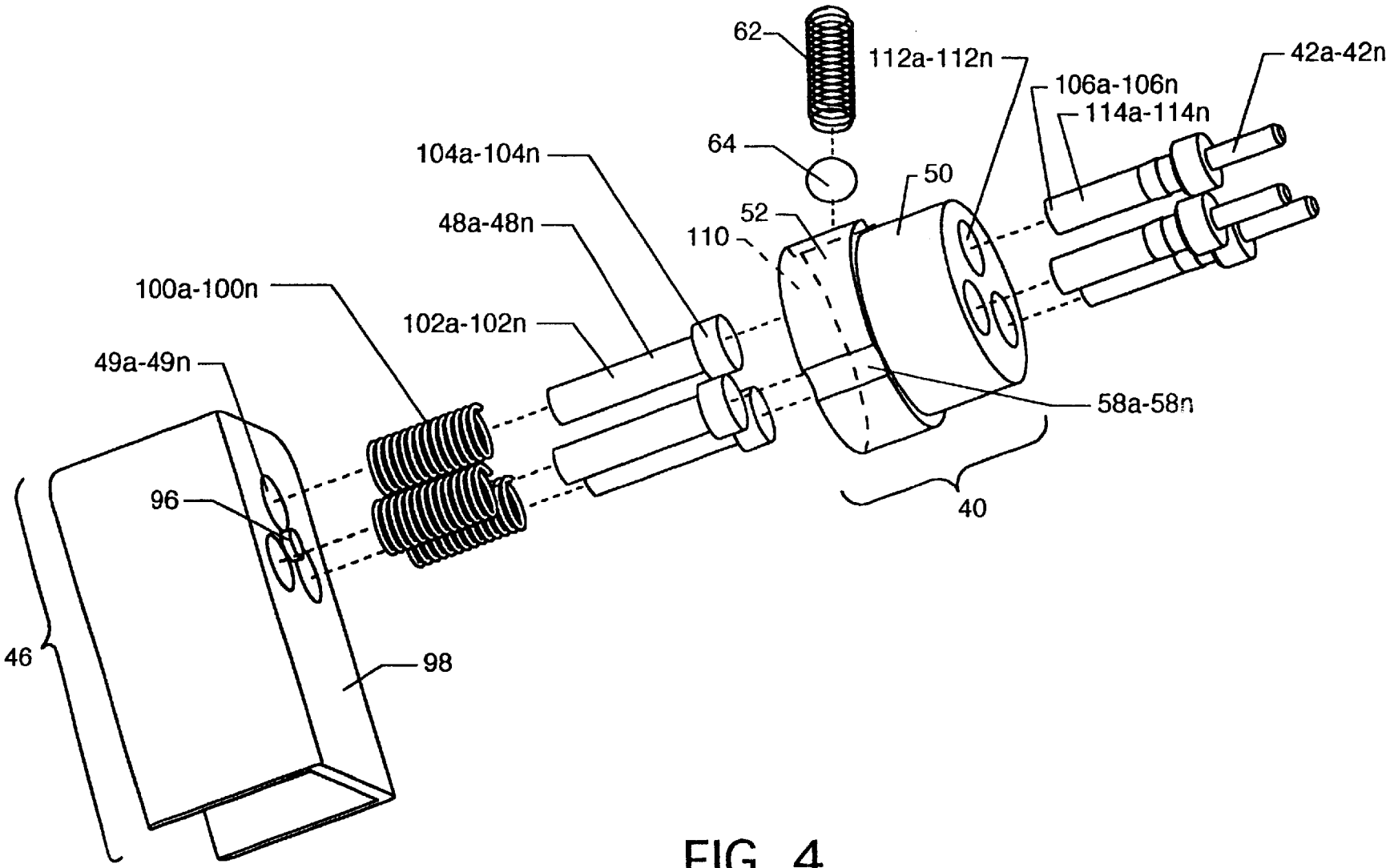
FIG. 4 illustrates an exploded isometric view showing the relationship of the rotary pin base and associated components with respect to the stationary pin base and associated components.

FIG. 2 illustrates a cross section of the warning system 10, the present invention, and the connector plugs 12 and 14, where all numerals correspond to those elements previously or otherwise described. Particularly illustrated is the alignment of the rotary pin base 40 and rotating pins 42*a*–42*n* with a stationary pin base 46 having spring loaded stationary switch pins 48*a*–48*n*. The spring loaded stationary switch pins 48*a*–48*n* are located in cavities 49*a*–49*n* in the stationary pin base 46 and are biased in a direction to cause intimate contact with the ends of the rotating pins 42*a*–42*n* which project slightly beyond the inwardly facing planar surface of the rotary pin base 40. The relationship of the rotary pin base 40 to the stationary pin base 46 is also illustrated in FIGS. 3 and 4 illustrating a rotary pin base 40 being generally of multi-radiused construction and a stationary pin base 46 being generally in the form of a sculpted rectangular solid. The small radius portion 50 of the rotary pin base 40 aligns in and is rotatably positionable within the cylindrically-shaped connector plug receptor port cavity 44 extending into the body of the configured housing 16. The larger radius portion 52 of the rotary pin base 40 and adjacent members provide and promote several features. One such feature is that an annular surface 54 (FIG. 3) which transitions between the large radius portion 52 and the small radius portion 50 of the rotary pin base 40 aligns to and acts as a stop against an inner planar surface 56 of the configured housing 16 which abuts the connector plug receptor port cavity 44. Another feature provided by the large radius portion 52 and other members is the inclusion of a plurality of grooved detents 58*a*–58*n* radially and equally and appropriately spaced about the curved surface of the large radius portion 52 of the rotary pin base 40. A vertically aligned cylindrically-shaped spring cavity 60 in the body of the configured housing 16 aligns transversely to the longitudinal axis of the large radius portion 52 of the rotary pin base 40 and includes a spring 62 and ball 64 arrangement correspondingly aligned where the ball 64 is forced by the spring 62 against the large radius portion 52 of the rotary pin base 40 to ultimately align with one of the grooved detents 58*a*–58*n* to provide reference, alignment and registration of the rotary pin base 40 and the rotating pins 42*a*–42*n* with the stationary pin base 46 and stationary switch pins 48*a*–48*n*. The stationary pin base 46, being of sculpted rectangular solid construction, aligns to four planar surfaces of a chamber 66 which intersects the connector plug receptor port cavity 44 and also aligns in close proximity to the inwardly facing surface of the rotary pin base 40 located in the connector plug receptor port cavity 44. Such alignment brings the stationary switch pins 48*a*–48*n* in the stationary pin base 46 into intimate electrical and physical contact with the rotating pins 42*a*–42*n* of the rotary pin base 40, as shown and described in detail in FIG. 5. An upper planar panel 68 having an access cutout 70 and a lower planar panel 72 are suitably secured by a plurality of screws 74*a*–74*n* into position between the tabs 18 and 20 to maintain the position of the stationary pin base 46 within the chamber 66 and to seal the bottom of the configured housing 16. Connector plug 14 includes a pin base 76 which serves as a mount for fixed position female pins 78*a*–78*n*. Connector plug 14 includes a tubular body 82 in or on which the pin base 76, fixed position female pins 78*a*–78*n* and a tightening ring 84 are located. An O-ring 80 is provided to seal the connector plug 14 to the connector plug receptor port 36. Connector plug 12 is of similar construction. Another connector plug receptor port 86 having fixed position male pins 88*a*–88*n* is also provided opposite the connector plug receptor port 36 for connection with connector plug 12.

FIG. 3 is an isometric view showing the relationship of the rotary pin base 40 and associated components in alignment to the stationary pin base 46, where all numerals correspond to those elements previously or otherwise described. A plurality of vertically oriented grooves 90*a*–90*n* and connecting passages are located on the rear vertical surface of the stationary pin base 46 to accommodate internal wiring which connects to the stationary switch pins 48*a*–48*n* previously described. Correspondingly, a plurality of vertically oriented grooves 92*a*–92*n* for wire passage are located in the configured housing 16 adjacent to the grooves 90*a*–90*n*, as viewed in FIG. 2. Rotary motion in either direction of the rotary pin base 40 is indicated by arcuate arrow 94.

Figure 5:
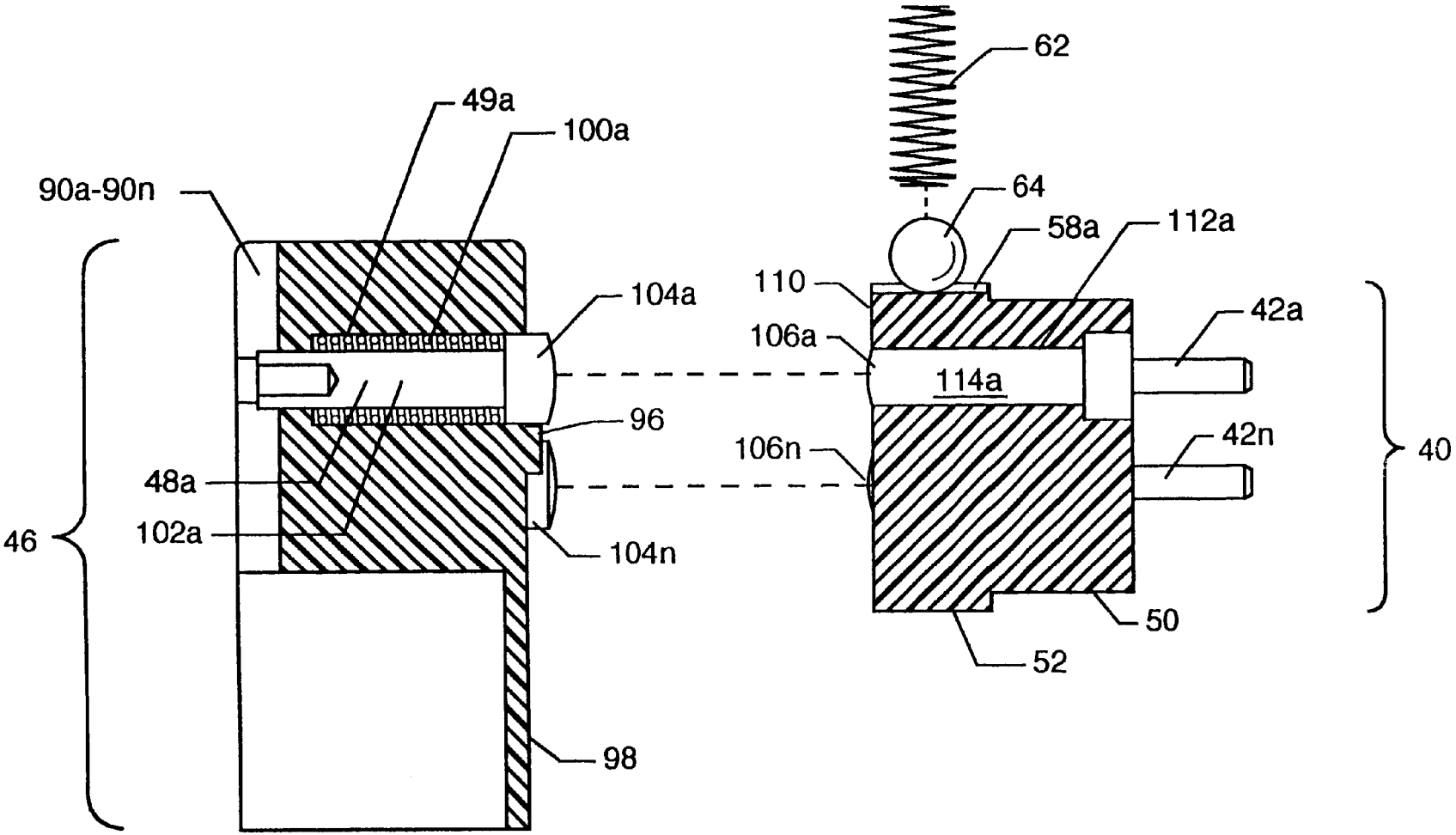
FIG. 5 is a separated cross section view along line 5—5 of FIG. 3 showing, for the purposes of brevity and clarity in semi-exploded view, intended and actual points of intimate contact of the stationary switch pins with the rotating pins; and, FIG. 6 is an end view showing the relationship of the grooved detents of the rotary pin base and associated components in alignment to the stationary pin base.

FIG. 4 is an exploded isometric view showing the relationship of the rotary pin base 40 and associated components with respect to the stationary pin base 46 and associated components, and FIG. 5 is a separated cross section view along line 5—5 of FIG. 3 showing, for the purposes of brevity and clarity in semi-exploded view, intended and actual points of intimate contact of the stationary switch pins 48*a*–48*n* with the rotating pins 42*a*–42*n* as shown by dashed lines, where all numerals correspond to those elements previously or otherwise described. Illustrated in particular in the stationary pin base 46 are cylindrical like cavities 49*a*–49*n* which are equally spaced from each other and which are equally spaced about an axis extending through a spacer pin 96 located on a planar surface 98 of the stationary pin base 46. Cavities 49*a*–49*n* respectively accommodate springs 100*a*–100*n* located over and about the co-located shafts 102*a*–102*n* of each of the stationary switch pins 48*a*–48*n* and also accommodate a portion of the domed pin heads 104*a*–104*n* of the stationary switch pins 48*a*–48*n,* as illustrated in FIG. 5. Slightly domed pin heads 104*a*–104*n* extend slightly beyond the planar surface 98 of the stationary pin base 46 to provide for suitable sliding contact with the inwardly facing domed ends 106*a*–106*n* of the rotating pins 42*a*–42*n,* the shafts 114*a*–114*n* of which mount in cylindrical like holes 112*a*–112*n* and extend slightly beyond the planar surface 110 of the rotary pin base 40. Holes 112*a*–112*n* are spaced and located about the central axis of the rotary pin base 40 to correspondingly align with cavities 49*a*–49*n* of the stationary pin base 46 to provide for suitable alignment of the rotating pins 42*a*–42*n* with the stationary switch pins 48*a*–48*n* residing respectively in the rotary pin base 40 and the stationary pin base 46. The spacer pin 96 ensures a suitable clearance space between the planar surface 98 of the stationary pin base 46 and the planar inwardly facing planar surface 110 of the rotary pin base 40.

Figure 6:
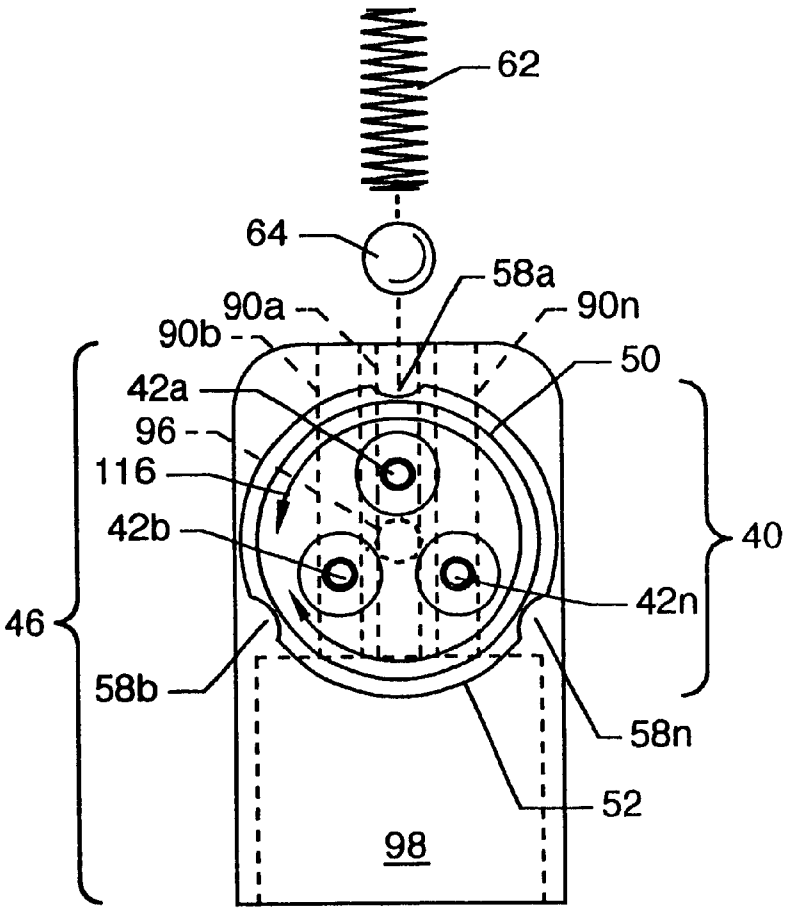

FIG. 6 is an end view showing the relationship of the grooved detents 58*a*–58*n* of the rotary pin base 40 and associated components in alignment to the stationary pin base 46, where all numerals correspond to those elements previously or otherwise described. Also shown is the ball 64 and spring 62 which in combination engage one of the grooved detents 58*a*–58*n* to index, reference, register and fix the rotating pins 42*a*–42*n* in the rotary pin base 40 in alignment with the stationary switch pins 48*a*–48*n* in the stationary pin base 46. Rotation in either direction of the rotary pin base 40 is indicated by arcuate arrow 116. Rotation of the rotary pin base, such as by the connector plug 14, forces the ball 64 out of engagement with one of the grooved detents 58*a*–58*n* into sliding or rotational tangential engagement with the large radius portion 52 of the rotary pin base 40 until reaching one of the next successive grooved detents 58*a*–58*n,* whereupon indexing, referencing, registration and/or fixation of the rotating pins 42*a*–42*n* in the rotary pin base 40 in alignment with the stationary switch pins 48*a*–48*n* in the stationary pin base 46 occurs. Such rotational urging of the rotary pin base 40 effects a switching between the rotating pins 42*a*–42*n* and the stationary switch pins 48*a*–48*n* to alter the behavior of the electric bulb 32 to be either flashing, steady or off, as required. Although sets of rotating pins 42*a*–42*n* and stationary switch pins 48*a*–48*n* indicate three pins in each set, other numbers of pins can be incorporated depending upon the number of switching combinations or settings desired and the use of only three-pin sets shall not be deemed to be limiting to the scope or intent of the invention.

Mode of Operation

FIG. 1, with reference to other figures, illustrates the mode of operation of the warning system 10. In use, the female pins 78*a*–78*n* of a connector plug, such as connector plug 14, engage the rotating pins 42*a*–42*n* of the rotary pin base 40 in physical and electrical connection to provide various and appropriate desired electrical currents to the rotating pins 42*a*–42*n* which then deliver such electrical current to the electric bulb 32 via the stationary switch pins 48*a*–48*n* located in the stationary pin base 46. Such desired engagement is provided firstly by proper orientation of the rotary pin base 40 by the engagement of the ball 64 in one of the grooved detents 58*a*–58*n,* and secondly, such engagement is ensured by securing of the connector plug 14 to the connector plug receptor port 36 by tightening of the tightening ring 84 over and about threads on the connector plug receptor port 36 to prevent any rotation of the tubular body 82 of the connector plug 14. Rotation of the rotary pin base 40 to effect a change in behavior of the electric bulb 32 is simply accomplished by unscrewing and loosening or disengaging the tightening ring 84 from the connector plug receptor port 36 to allow subsequent manual rotation of the tubular body 82 of the connector plug 14. Manual rotation of the tubular body 82 correspondingly causes rotation of the rotating pins 42*a*–42*n* and of the rotary pin base 40 to a new detent position, such as determined by the engagement of the ball 64 with a successive grooved detent 58*a*–58*n*. Rotation of the rotary pin base 40 by the connector plug 14 forces the ball 64 out of engagement with one of the grooved detents 58*a*–58*n* into sliding or rotational tangential engagement with the large radius portion 52 of the rotary pin base 40 until reaching one of the next successive grooved detents 58*a*–58*n,* whereupon indexing, referencing, registration and/or fixation of the rotating pins 42*a*–42*n* in the rotary pin base 40 in alignment with the stationary switch pins 48*a*–48*n* in the stationary pin base 46 occurs. Such rotational urging of the rotary pin base 40 effects a switching between the rotating pins 42*a*–42*n* and the stationary switch pins 48*a*–48*n* to alter the behavior of the electric bulb 32 to be either flashing, steady or off or as otherwise required. Upon reaching the desired detented position, the tightening ring 84 is re-secured to prevent inadvertent rotation of the tubular body 82 of the connector plug 14, further ensuring the desired rotational setting. Although opposing sets of rotating pins 42*a*–42*n* and stationary switch pins 48*a*–48*n* indicate three pins in each set, other numbers of pins and additional switching arrangements incorporating the teachings of the invention can be incorporated depending upon the number of switching combinations or settings desired. The use of only three-pin sets or only one set of switching means shall not be deemed to be limiting to the scope or intent of the invention.

Various modifications can be made to the present invention without departing from the apparent scope hereof.

PARTS LIST

| | |
|---|---|
| 10 | warning system |
| 12 | connector plug |
| 14 | connector plug |
| 16 | housing, configured |
| 18 | tab |
| 20 | tab |
| 22a–n | mounting holes |
| 24 | lens frame |
| 26 | lens |
| 28 | lens |
| 30 | lamp base |
| 32 | electric bulb |

-continued

| | |
|---|---|
| 34 | orifice |
| 36 | connector plug receptor part |
| 38 | side |
| 40 | rotary pin base |
| 42a–n | rotating pins |
| 44 | connector plug receptor port cavity |
| 46 | stationary pin base |
| 48a–n | stationary switch pins |
| 49a–n | cavities |
| 50 | small radius portion |
| 52 | large radius portion |
| 54 | annular surface |
| 56 | inner planar surface |
| 58a–n | grooved detents |
| 60 | spring cavity |
| 62 | spring |
| 64 | ball |
| 66 | chamber |
| 68 | upper planar panel |
| 70 | access cutout |
| 72 | lower planar panel |
| 74a–n | screws |
| 76 | pin base |
| 78a–n | female pins |
| 80 | O-ring |
| 82 | tubular body |
| 84 | tightening ring |
| 86 | connector plug receptor port |
| 88a–n | male pins |
| 90a–n | grooves |
| 92a–n | grooves |
| 94 | arcuate arrow |
| 96 | spacer pin |
| 98 | planar surface |
| 100a–n | springs |
| 102a–n | shafts |
| 104a–n | domed pinheads |
| 106a–n | domed ends |
| 110 | planar surface |
| 112a–n | holes |
| 114a–n | shafts |
| 116 | arcuate arrow |

What is claimed is:

1. A warning light having a switching system, comprising:

a. a housing;

b. a lamp supported by said housing;

c. a rotatable base supported by said housing;

d. a set of switch pins carried by said rotatable base, each switch pin having a first end exposed at the outside of said housing for mating with a contact of a plug and a second end located within said housing;

e. a stationary base located within said housing in alignment with said rotatable base; and, f. a set of switch pins carried by said stationary base, each switch pin having a first end in abutting engagement with a respective said second end of a said switch pin carried by said rotatable base and a second end electrically connected to said lamp.

2. The warning light having a switching system as defined in claim 1, wherein each of said switch pins carried by said stationary base has a spring associated therewith which biases the first end thereof into said abutting engagement with a respective said second end of a said switch pin carried by said rotatable base.

3. The warning light having a switching system as defined in claim 1, wherein said rotatable base includes an outer surface with grooved detents therein, and wherein said housing includes a cavity containing a spring-biased ball for engaging into said grooved detents.

4. The warning light having a switching system as defined in claim 1, wherein said first ends of said switch pins which are carried by said rotatable base and which are exposed at the outside of said housing for mating with contacts of a plug are located within a plug receptor port formed on said housing.

5. The warning light having a switching system as defined in claim 1, and further comprising a set of connector pins extending through a wall of said housing, each connector pin having a first end exposed at the outside of said housing for mating with a contact of a plug and a second end located within said housing and electrically connected to said lamp.

6. The warning light having a switching system as defined in claim 5, wherein said first ends of said switch pins which are carried by said rotatable base and which are exposed at the outside of said housing for mating with contacts of a plug are located within a first plug receptor port formed on said housing, and wherein said first ends of said connector pins extending through a wall of said housing and which are exposed at the outside of said housing for mating with contacts of a plug are located within a second plug receptor port formed on said housing.

7. The warning light having a switching system as defined in claim 1, wherein said set of switch pins carried by said rotatable base consists of three switch pins, and wherein said set of switch pins carried by said stationary base consists of three switch pins.

8. A warning light having a switching system, comprising:

a. a housing;

b. an electric light bulb supported by said housing;

c. a plug receptor port formed on said housing;

d. a rotatable base having a front portion residing in said plug receptor port and a rear portion located within said housing;

e. a plurality of switch pins carried by said rotatable base, each switch pin having a first end terminating within said plug receptor port and a second end terminating within said housing;

f. a stationary base located within said housing; and, g. a plurality of switch pins carried by said stationary base, each switch pin having a first end in abutting engagement with a respective said second end of a said switch pin carried by said rotatable base and a second end electrically connected to said electric light bulb.

9. The warning light having a switching system as defined in claim 8, and further comprising another plug receptor port formed on said housing, and a plurality of connector pins each having a first end terminating in said another plug receptor port and a second end terminating within said housing and electrically connected to said electric light bulb.

10. The warning light having a switching system as defined in claim 8, wherein said electric light bulb is capable of operation in either a continuous illumination mode or a flashing illumination mode, and wherein rotation of said rotatable base effects switching between said switch pins carried by said rotatable base and said switch pins carried by said stationary base to change the illumination mode of said electric light bulb from one illumination mode to the other.

11. The warning light having a switching system as defined in claim 8, wherein each of said switch pins carried by said stationary base has a spring associated therewith which biases the first end thereof into said abutting engagement with a respective said second end of a said switch pin carried by said rotatable base.

12. The warning light having a switching system as defined in claim 8, wherein said rotatable base includes an outer surface with grooved detents therein, and wherein said housing includes a cavity containing a spring-biased ball for engaging into said grooved detents.

13. In a railroad crossing arm hazard signal system which includes a warning light having a switching system that comprises a housing, a lamp supported by the housing, a stationary base within the housing carrying a plurality of switch pins each having a first end electrically connected to the lamp and a second end abutting against a first end of a respective one of a plurality of switch pins carried by a rotatable base supported by the housing, the plurality of switch pins carried by the rotatable base each having a second end engaged with a respective contact of a plug at an end of a cable, which plug is secured against rotation relative to the housing by a tightening ring, a process for changing the lighting mode of the lamp from continuous to flashing or vice versa comprising the steps of:

a. loosening the tightening ring to enable the plug to be rotated relative to the housing;

b. rotating the plug while the contacts thereof are maintained engaged with the switch pins carried by the rotatable base thereby causing rotation of the rotatable base and the consequent switching of the switch pins carried by the rotatable base with respect to the switch pins carried by the stationary base to change the lighting mode of the lamp; and, c. retightening the tightening ring to resecure the plug against rotation relative to the housing.

* * * * *